US008397462B2

(12) United States Patent
Gulbrandsen et al.

(10) Patent No.: US 8,397,462 B2
(45) Date of Patent: Mar. 19, 2013

(54) OPEN WEB GRID RUNNER

(75) Inventors: Peder J. Gulbrandsen, Aurora, IL (US); James J. Lehane, Jr., McHenry, IL (US); Abraham M. Underkofler, Waukegan, IL (US)

(73) Assignee: USG Interiors, LLC, Chicago, IL (US)

( * ) Notice: Subject to any disclaimer, the term of this patent is extended or adjusted under 35 U.S.C. 154(b) by 0 days.

(21) Appl. No.: 13/152,355

(22) Filed: Jun. 3, 2011

(65) Prior Publication Data

US 2012/0304574 A1 Dec. 6, 2012

(51) Int. Cl.

| | |
|---|---|
| ***E04B 1/18*** | (2006.01) |
| ***E04B 5/10*** | (2006.01) |
| ***E04B 5/18*** | (2006.01) |
| ***E04C 3/02*** | (2006.01) |

(52) U.S. Cl. ..... 52/636; 52/506.07; 52/506.08; 52/506.09; 52/506.1

(58) Field of Classification Search ..... 52/506.06, 52/506.07, 506.08, 506.09, 506.01, 636, 52/506.1

See application file for complete search history.

(56) References Cited

U.S. PATENT DOCUMENTS

| | | | |
|---|---|---|---|
| 184,522 | A | 11/1876 | Hammond |
| 573,151 | A | 12/1896 | Johnson |
| 1,006,047 | A | 10/1911 | Bates |
| 2,029,645 | A | 2/1936 | Waugh |
| 2,052,024 | A | 8/1936 | Hahn |
| 2,055,756 | A | 9/1936 | Sutton |
| 2,108,373 | A | 2/1938 | Greulich |
| 2,141,642 | A | 12/1938 | Cross |
| 2,142,637 | A | 1/1939 | Faber |
| 3,214,875 | A | 11/1965 | Dawdy |
| 3,256,670 | A | 6/1966 | Ennio |
| 3,381,439 | A | 5/1968 | Thulin, Jr. |
| 3,789,563 | A | 2/1974 | Toti |
| 3,800,490 | A | 4/1974 | Conte |
| 3,840,960 | A | 10/1974 | Toti |

(Continued)

FOREIGN PATENT DOCUMENTS

| | | | |
|---|---|---|---|
| GB | 504 405 | A | 4/1939 |
| WO | 97/06321 | A1 | 2/1997 |

(Continued)

OTHER PUBLICATIONS

International Search Report and Written opinion dated Aug. 2, 2012 of corresponding International PCT Application No. PCT/US2012/036229, filed May 3, 2012.

*Primary Examiner* — William Gilbert
*Assistant Examiner* — Chi Q Nguyen
(74) *Attorney, Agent, or Firm* — Pearne & Gordon LLP

(57) ABSTRACT

A suspended ceiling grid runner comprising separate parallel upper and lower chords, a plurality of identical web plates fixed between the chords and the plates having a height less than the height of the grid runner and a width, the chords being made of roll-formed sheet metal strips and symmetrical about a vertical plane, the chordal strips each having marginal sections folded parallel to one another and on opposite sides of the vertical plane, the web plates including vertical slots for receiving connectors of cross runners, the web plates being spaced at regular centers along the grid runner with a distance that is a small fraction of the nominal length of the grid runner, the gaps between adjacent web plates being longer than the height of the grid runner.

8 Claims, 3 Drawing Sheets

U.S. PATENT DOCUMENTS

| | | | | | |
|---|---|---|---|---|---|
| 4,206,578 | A | | 6/1980 | Mieyal | |
| 4,207,719 | A | | 6/1980 | Knowles | |
| 4,442,650 | A | | 4/1984 | Sivachenko | |
| 4,489,529 | A | | 12/1984 | Ollinger et al. | |
| 4,494,350 | A | * | 1/1985 | Sharp | 52/665 |
| 4,525,972 | A | | 7/1985 | Palacio et al. | |
| 4,548,014 | A | | 10/1985 | Knowles | |
| 4,702,059 | A | | 10/1987 | Holtz | |
| 4,713,919 | A | | 12/1987 | Platt | |
| 4,765,111 | A | * | 8/1988 | Osawa | 52/509 |
| 5,664,388 | A | | 9/1997 | Chapman | |
| 5,842,318 | A | | 12/1998 | Bass et al. | |
| 5,979,055 | A | * | 11/1999 | Sauer et al. | 29/897.35 |
| 6,047,511 | A | | 4/2000 | Lehane | |
| 6,115,986 | A | | 9/2000 | Kelly | |
| 6,131,362 | A | | 10/2000 | Buecker | |
| 6,170,217 | B1 | | 1/2001 | Meyer | |
| 6,418,694 | B1 | * | 7/2002 | Daudet et al. | 52/650.1 |
| 6,526,716 | B2 | | 3/2003 | Paul | |
| 6,796,093 | B2 | | 9/2004 | Brandes | |
| 6,912,787 | B1 | | 7/2005 | Ruble et al. | |
| 7,231,746 | B2 | | 6/2007 | Bodnar | |
| 7,516,585 | B2 | * | 4/2009 | Lehane et al. | 52/506.07 |
| 7,587,877 | B2 | | 9/2009 | Strickland et al. | |
| D618,826 | S | | 6/2010 | Lehane, Jr. | |
| 7,765,762 | B2 | * | 8/2010 | Gulbrandsen et al. | 52/506.09 |
| 7,832,168 | B2 | * | 11/2010 | Lehane et al. | 52/506.07 |
| 7,877,961 | B2 | | 2/2011 | Strickland et al. | |
| 7,908,813 | B2 | * | 3/2011 | Gulbrandsen et al. | 52/506.09 |
| 8,033,076 | B2 | * | 10/2011 | Plagemann et al. | 52/653.1 |
| 2007/0028554 | A1 | | 2/2007 | Ferrell et al. | |
| 2007/0113507 | A1 | | 5/2007 | Lehane | |
| 2007/0277466 | A1 | | 12/2007 | Platt | |
| 2008/0148668 | A1 | | 6/2008 | Jahn | |
| 2010/0257807 | A1 | | 10/2010 | Raheel et al. | |
| 2011/0247296 | A1 | | 10/2011 | Stal et al. | |

FOREIGN PATENT DOCUMENTS

| | | | |
|---|---|---|---|
| WO | 2004/109030 | A1 | 12/2004 |

* cited by examiner

OPEN WEB GRID RUNNER

BACKGROUND OF THE INVENTION

The invention relates to suspended ceiling grid construction.

PRIOR ART

Suspended ceilings typically include a rectangular metal grid on which are supported ceiling tiles or drywall panels. The commercial construction industry is highly competitive and, accordingly, the cost of building materials in this sector is important. Raw material consumption, particularly material without a large recycled content is likewise a concern for preservation of the environment. Accordingly, there is a need for suspended grid products that consume less material and can be economically produced.

SUMMARY OF THE INVENTION

The invention provides a grid runner for a suspended ceiling of reduced material content and potentially with improved torsional strength. The grid runner of the invention takes the form of a parallel chord truss with an open web. The web is comprised of plates at regularly spaced locations corresponding to potential cross runner locations and is otherwise open. The chords can have cross-sections corresponding to known grid tee profiles. The upper chord can include, for example, a rectangular hollow box cross-section, and the lower chord can include a similar hollow box section and associated flange sections, or can take the form of a simple tee shape.

In one disclosed embodiment, the web plates are received between folded marginal or edge sections of metal strips forming the chords. The marginal sections of the chord strips and the plates are fixed together by integral stitching, for example.

In another disclosed embodiment, marginal sections of the chord strips are lapped directly together and are jointly lanced at longitudinally spaced regions corresponding to the desired plate locations. The web plates are configured to be received in the lances. The lances, after receiving the web plates, are tightly pressed to permanently fix the plates and chords together.

The invention provides a high degree of flexibility in the selection of materials used in the top and bottom chords as well as the web plates. These components can be made of different materials, gauges, and quality. Usually, the components are made of a metal such as steel or aluminum. The web plates can be made of an electrically non-conductive material such as a suitable plastic so that the chords are electrically insulated from one another.

The invention, where desired, enables the strip forming the lower chord to form a closed box section which can potentially increase torsional strength of the grid member.

DESCRIPTION OF THE PREFERRED EMBODIMENTS

Figure 1:
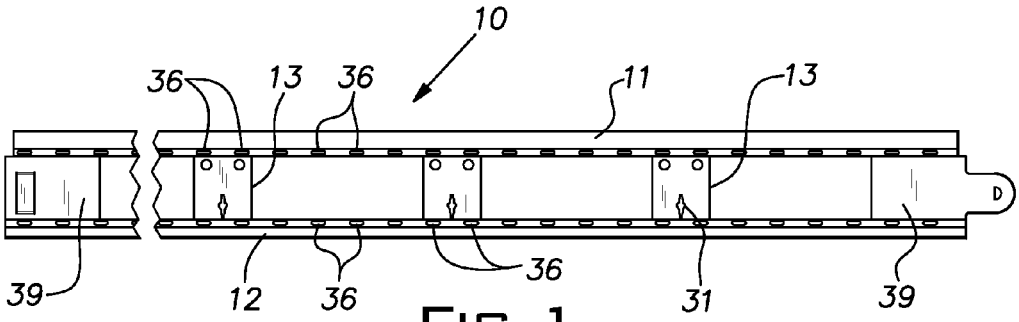
FIG. 1 is a fragmentary side elevational view of a grid runner embodying the invention.
Figure 2:
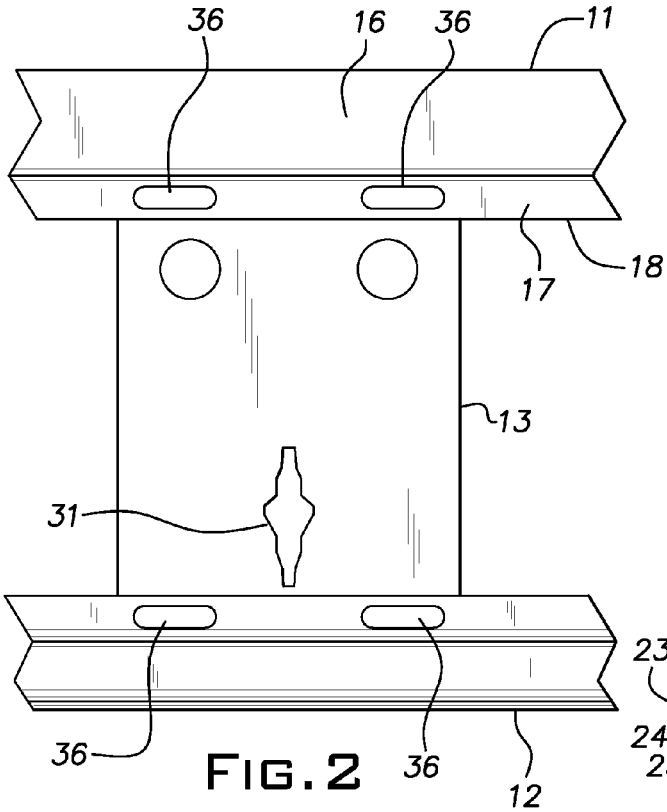
FIG. 2 is an enlarged side view of a web plate and portions of top and bottom chords of the grid runner of FIG. 1.
Figure 3:
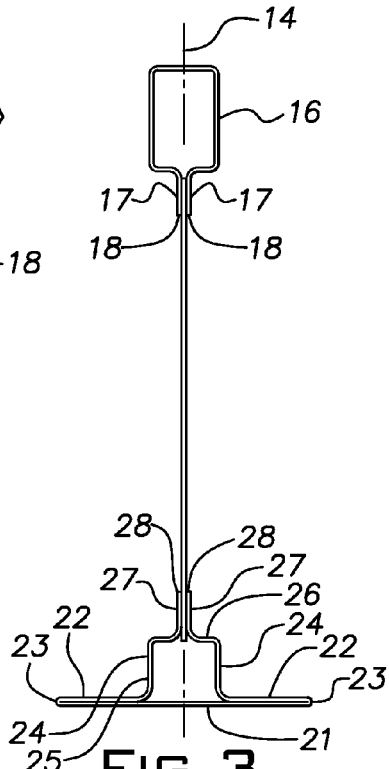
FIG. 3 is an enlarged cross-sectional view of the grid runner of FIG. 1 taken in a plane transverse to its length.
Figure 4:
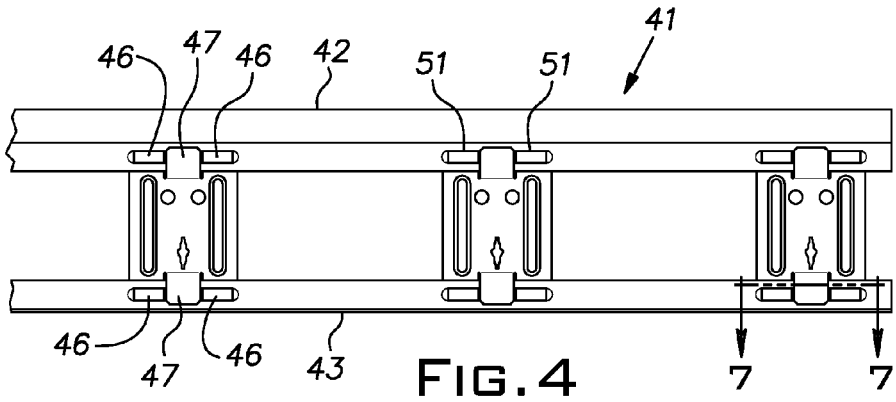
FIG. 4 is a fragmentary side elevational view of a second embodiment of a grid runner of the invention.
Figure 5:
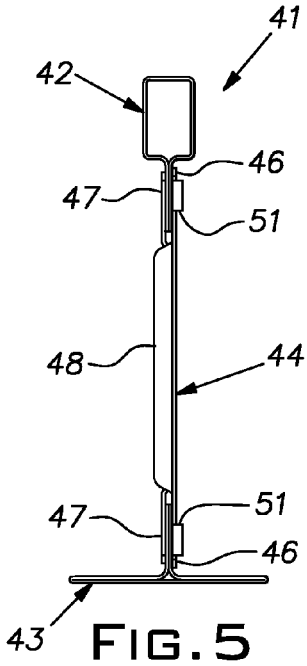
FIG. 5 is a cross sectional view of the grid runner of FIG. 4, on an enlarged scale taken in a plane transverse to its length.
Figure 6:
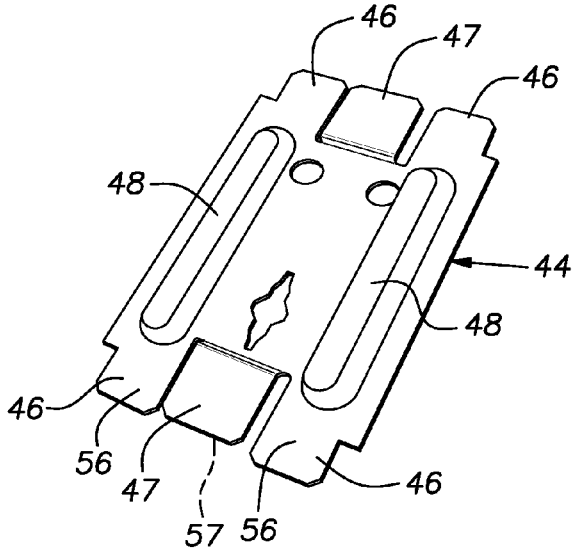
FIG. 6 is a perspective view of a web plate of the grid runner of FIG. 4.
Figure 7:
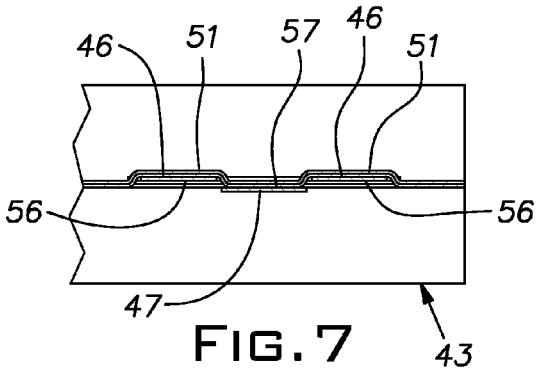
FIG. 7 is a sectional view of a web plate and lower chord taken in the plane 7-7 indicated in FIG. 4.

FIGS. 1-3 illustrate a first embodiment of a grid runner 10 constructed in accordance with the invention. The grid runner 10 is an elongated member having a cross-section, illustrated in FIG. 3, of an inverted tee much like a conventional prior art grid tee known to those familiar with the art. The grid member 10 includes parallel upper and lower chords 11, 12, respectively, and longitudinally spaced web plates 13.

The chords 11, 12 are preferably roll-formed from sheet metal strips, typically hot-dipped galvanized steel. The plates 13 can be of the same material as the chords. In the illustrated embodiment, the chords 11, 12 are each symmetrical about an imaginary vertical plane indicated at 14 in FIG. 3. Preferably, each of the chords 11, 12 are formed of a single metal strip. The upper chord 11 has a hollow box section 16 and two depending skirts formed by marginal sections 17 of the chord strip extending to longitudinal edges 18.

The lower chord 12 is rolled or otherwise made with a lower horizontal flange face 21 and, at distal edges 23 of the flange face is folded back on itself to afford double layer flange sections 22. Ultimately, the flange sections or portions 22 in a customary manner, support lay-in ceiling tiles or drywall sheet after the grid member or runner 10 is assembled in a suspended rectangular grid. Between distal flange edges 23 and the plane 14, the lower chord strip is folded or bent up to form sides 24 of a box section 25 and over to form a top 26 of the box section. Adjacent the central plane 14, the lower chord strip is folded up to form upstanding marginal sections 27, terminating at longitudinal edges 28.

The illustrated web plates 13 have centrally located, in the widthwise direction, vertically oriented through slots 31 for receiving cross-runner connectors in a manner well-known in the art. The web plates 13 are spaced from each other in the longitudinal direction of the runner 10 a distance that is preferably substantially greater than the width of the plate. For example, in the illustrated embodiment, the grid runner 10 is 2" high, the plates are on 6" centers, and the plates are about 1" wide. This center-to-center spacing is desirable since it affords a cross-runner slot at convenient locations when a grid is being assembled.

The strip or body of the lower chord 12 can be painted on the side that is visible from below when the grid runner 10 is to be used with ceiling tile. Painting of this strip can be omitted when the grid runner is to be used to support a drywall ceiling. The body strips of the chords 11 and 12 can have the same or similar gauge or thickness. In one example made of hot dipped galvanized steel, the upper chord 11 had a gauge of 0.012", the lower chord 12 had a gauge of 0.014", and the plates 13 had a gauge of 0.016".

The web plates 13 can be assembled with the chords 11 and 12 as the chords are being roll-formed. The plates 13 are disposed between the marginal sections 17, 27 of the upper and lower chords 11, 12. The height of the plates 13 can be limited so neither the top nor the bottom of a plate extends into the hollow areas of the upper and lower chords 11, 12.

In the illustrated construction, the plates 13 are mechanically fixed in position on the chords 11, 12 by integral stitches 36. Preferably, two or more stitches secure each of the top and bottom of a plate 13, but at least two stitches should exist on either the top or bottom and one stitch should exist on the opposite end of the plate. The stitches can be of the type in which a slug of material is lanced through the three contacting layers of the chord strip and plate and the lanced material is expanded in directions of its plane and thereafter pressed back towards the original planes of the lanced material. Other suitable manners of forming stitches are disclosed in U.S. Pat. Nos. 6,047,511 and 5,979,055.

Stitches 36, as shown, can be made on the chord strip marginal sections 17, 27 at locations intervening the web plates 13. Besides serving the primary purpose of fixing the plates 13 to the chords 11, 12, the stitches increase the torsional stiffness of the grid runner 10.

The wide spacing of the web plates 13 relative to the height of the grid runner 10 obtains significant material savings, being as much as about 25% savings in material over conventional grid runner constructions. As mentioned, the web plate center-to-center spacing 13 can be 6" and the grid runner can be supported adequately at 48" spans so that the web plates are disposed on centers as large as ⅛ the design span thereby leaving large open areas between the web plates. Typically, a main grid runner 10 will be manufactured with a nominal 12' length. Plates 39 with integral or separate end connectors, known in the art, are used to connect identical grid runners end-to-end.

Referring now to FIGS. 4-7, another form of open web grid runner 41 constructed in accordance with the invention is illustrated. The grid runner 41 has upper and lower chords 42, 43 joined by web plates 44. The chords 42, 43 are preferably roll-formed of sheet metal and like the embodiment of FIGS. 1-3 can be hot-dipped galvanized steel with a gauge 0.014 or 0.016, for example. The plates 44 can be the same or similar material and gauge.

At its top and bottom, a plate 44 is divided into three vertically extending tabs 46, 47 separated by intervening cut lines. Center tabs 47 are offset from and parallel to the plane of the main body of the plate 44. A pair of embossed ribs 48 are formed in the plate 44 between opposed outer tabs 46 to stiffen the plate.

For each intended plate location, the upper and lower chords 42, 43 are each formed with two longitudinally spaced lances 51. Each lance 51 is cut through respective double marginal sections 52, 53 of the sheet or body forming the respective upper and lower chords. The length of the lances 51 in the longitudinal direction of the chords 42, 43, is sufficient to receive one of the outer tabs 46. The plates 44 are assembled with the chords 42, 43 by locating the outer tabs 46 in respective lances or pockets 51. The offset of the plane of the center tab 47 is sufficient to permit the double marginal sections 52, 53 of the chords 42, 43 to fit in a space between planes of opposite faces 56, 57 of the tabs 46, 47.

The plates 44 have cross tee slots 49 and holes 50 for receiving suspension wires. The plates 44 are mechanically fixed or locked to the chords 42, 43 by pressing the lances 51 tightly against the outer tabs 46 and the inner tab 47 tightly against the marginal sections 52, 53 of the chords 42, 43.

Figure 9:
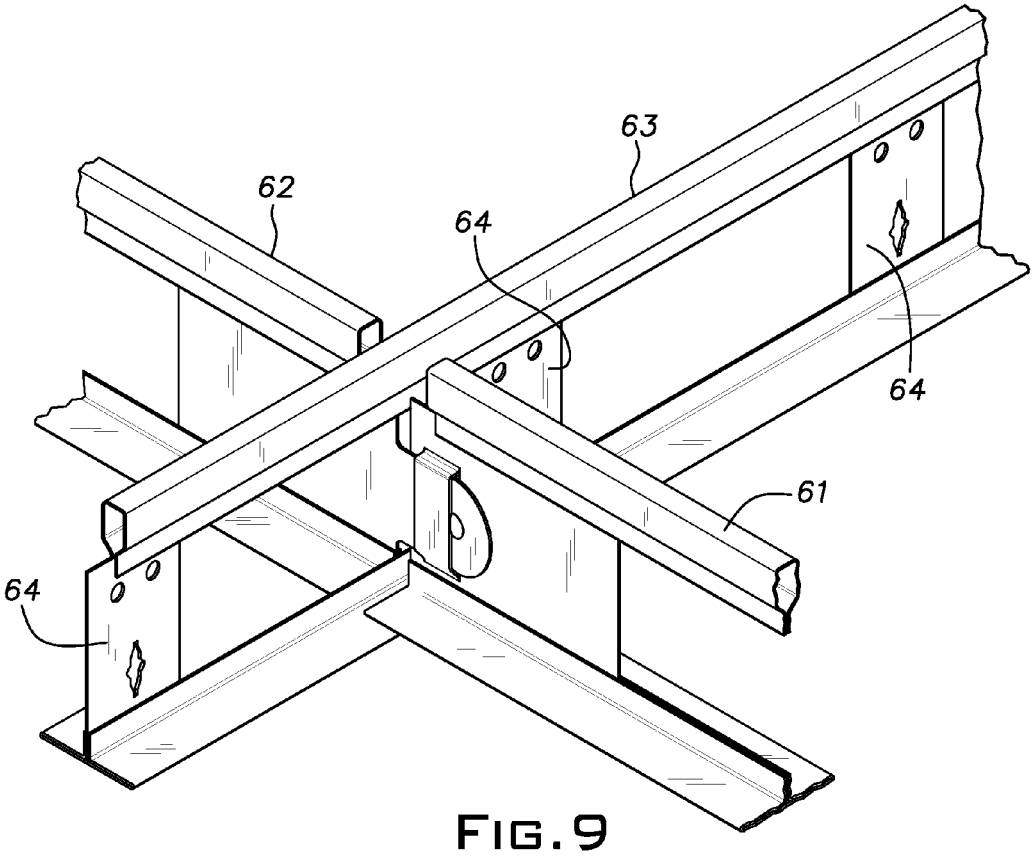
FIG. 9 is a somewhat schematic view of an intersection between grid runners of the invention.

FIG. 9 schematically illustrates a unique advantage offered by the open web construction of the grid runners. A pair of grid runners 61, 62 transversely intersecting a main runner 63 are shown to be connected end-to-end at a location between web plates 64 of the intersected runner 63. The ability of the transverse cross runners 61, 62 to be positioned wherever desired between the web plates 64 and be connected end-to-end can be useful in suspended drywall systems where the joints of the drywall panels do not line-up with a center of a web plate 64.

Figure 8:
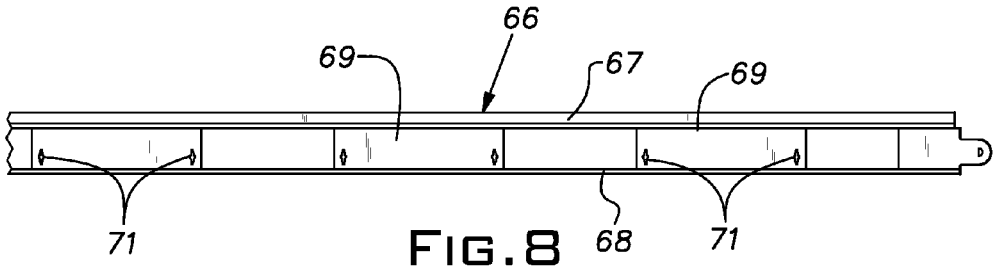
FIG. 8 is a fragmentary side view of a third embodiment of a grid runner constructed in accordance with the invention.

FIG. 8 shows a third embodiment of a grid runner 66 of the invention. The grid runner 66 has upper and lower chords 67, 68 which can be the same as those shown in the embodiment of FIGS. 1-3. In this third embodiment, web plates 69 are sufficiently long to provide two cross-runner connector receiving slots 71 with the slots on 6" centers, for example. The plates 69 are spaced from one another along the length of the chords 67, 68 by a relatively large distance by, for example, 5". The plates 69 can be fixed to the chords 66, 67 by the stitching process described in connection with the embodiment of FIGS. 1-3. The arrangement of the plates 69 reduces the number of plates required for constructing a grid runner 66 while still affording considerable savings in material.

While the invention has been shown and described with respect to particular embodiments thereof, this is for the purpose of illustration rather than limitation, and other variations and modifications of the specific embodiments herein shown and described will be apparent to those skilled in the art all within the intended spirit and scope of the invention. Accordingly, the patent is not to be limited in scope and effect to the specific embodiments herein shown and described nor in any other way that is inconsistent with the extent to which the progress in the art has been advanced by the invention. It will be understand, for example, rather than simply being rectangular, the web plates can be of other polygonal shapes, and the web plates can be fixed to respective chords by other techniques such as by welding, adhesives, or separate fasteners.

What is claimed is:

1. A grid runner for a suspended ceiling comprising separate parallel upper and lower chords, a plurality of identical web plates extending vertically between the chords and being rigidly fixed thereto, the grid runner having a height, the web plates having a height less than the height of the grid runner and a width, the chords being made of roll-formed sheet metal strips and having cross-sections symmetrical about a vertical plane, the chord strips each having marginal sections folded parallel to one another and on opposite sides of the vertical plane, the marginal sections of the upper chord strip having longitudinal edges at the lower side of the upper chord and the marginal sections of the lower chord strip having longitudinal edges at the upper side of the lower chord and vertically spaced from the longitudinal edges of the upper cord, the web plates being disposed in said vertical plane and including vertical slots for receiving connectors of cross runners, the web plates being spaced at regular centers along the grid runner with a distance that is a small fraction of the nominal length of the grid runner, gaps between adjacent web plates being longer than the height of the grid runner.

2. A grid runner as set forth in claim 1, wherein the gap between adjacent web plates is longer than the width of a web plate.

3. A grid runner as set forth in claim 1, wherein the chord strips and web plates are of about the same gauge thickness.

4. A grid runner as set forth in claim 1, wherein the web plates each include two longitudinally spaced cross-runner connector slots.

5. A grid runner as set forth in claim 1, wherein the upper chord strip encloses a longitudinally extending hollow space with transverse dimensions substantially greater than a double thickness of the upper chord strip.

6. A grid runner as set forth in claim 5, wherein the lower chord strip encloses a longitudinally extending hollow space having transverse dimensions substantially greater than a double thickness of the lower chord strip.

7. A grid runner as set forth in claim 1, wherein the web plates are disposed between the marginal sections of the upper and lower chord strips.

8. A grid runner as set forth in claim 1, wherein the web plates have vertically extending tabs at upper and lower sides of the web plates, said marginal sections of said upper and lower chord strips including laterally lanced pockets, said web plate tabs being fixed in said lanced pockets of respective upper and lower chords.

* * * * *

UNITED STATES PATENT AND TRADEMARK OFFICE

CERTIFICATE OF CORRECTION

PATENT NO. : 8,397,462 B2
APPLICATION NO. : 13/152355
DATED : March 19, 2013
INVENTOR(S) : Peder J. Gulbrandsen et al.

It is certified that error appears in the above-identified patent and that said Letters Patent is hereby corrected as shown below:

In the Claims:

Column 4, line 56 (Claim 1, line 14), after "cord" insert --strip--.

Signed and Sealed this
Fourteenth Day of May, 2013

Teresa Stanek Rea
*Acting Director of the United States Patent and Trademark Office*